US010138105B2

(12) United States Patent
Niehr et al.

(10) Patent No.: US 10,138,105 B2
(45) Date of Patent: Nov. 27, 2018

(54) MACHINE AND METHOD FOR FILLING CONTAINERS AND CLEANING METHOD

(71) Applicant: KHS GmbH, Dortmund (DE)

(72) Inventors: Thomas Niehr, Bad Münster am Stein Ebernburg (DE); Jürgen Vorwerk, Mönsdorf (DE); Andreas Lörcks, Oer-Erkenschwick (DE)

(73) Assignee: KHS GmbH, Dortmund (DE)

( * ) Notice: Subject to any disclaimer, the term of this patent is extended or adjusted under 35 U.S.C. 154(b) by 507 days.

(21) Appl. No.: 14/772,534

(22) PCT Filed: Jan. 28, 2014

(86) PCT No.: PCT/EP2014/000208
§ 371 (c)(1),
(2) Date: Sep. 3, 2015

(87) PCT Pub. No.: WO2014/135238
PCT Pub. Date: Sep. 12, 2014

(65) Prior Publication Data

US 2016/0137472 A1 May 19, 2016

(30) Foreign Application Priority Data

Mar. 8, 2013 (DE) ..... 10 2013 003 931

(51) Int. Cl.
*B67C 3/22* (2006.01)

(52) U.S. Cl.
CPC ..... *B67C 3/22* (2013.01); *B67C 2003/228* (2013.01)

(58) Field of Classification Search
CPC ..... B67C 3/22; B67C 2003/228
See application file for complete search history.

(56) References Cited

U.S. PATENT DOCUMENTS

| | | | |
|---|---|---|---|
| 2,514,072 | A | 7/1950 | Kantor |
| 2,638,259 | A | 5/1953 | Garrett |
| 3,570,556 | A | 3/1971 | Anderson |
| 6,148,876 | A | 11/2000 | Corniani et al. |
| 6,334,473 | B1 | 1/2002 | Dumargue |

FOREIGN PATENT DOCUMENTS

| | | |
|---|---|---|
| DE | 19 02 049 | 8/1970 |
| DE | 25 53 989 | 8/1976 |
| DE | 10 2007 041 684 | 3/2009 |
| EP | 0 974 548 | 1/2000 |

*Primary Examiner* — Timothy L Maust
*Assistant Examiner* — Timothy P Kelly
(74) *Attorney, Agent, or Firm* — Occhiuti & Rohlicek LLP

(57) ABSTRACT

A filling machine includes a rotor, a rotor bearing that rotatably mounts the rotor on the machine-frame for rotation about a machine axis, and filling elements disposed on the rotor. Each filling element, together with a container carrier, defines a filling point. The machine includes a filling-material boiler arranged on the rotor and configured to rotate with the rotor, as well as a boiler-cover connected to the machine-frame and configured to not rotate with the rotor, and a seal. The seal seals a transition between the boiler cover and the filling-material boiler.

16 Claims, 5 Drawing Sheets

MACHINE AND METHOD FOR FILLING CONTAINERS AND CLEANING METHOD

RELATED APPLICATIONS

This application is the national stage under 35 USC 371 of international application PCT/EP2014/000208, filed on Jan. 28, 2014, which claims the benefit of the Mar. 8, 2013 priority date of German application DE 102013003931.2, the contents of which are herein incorporated by reference.

FIELD OF INVENTION

The invention relates to a container processing, and in particular, filling machines and filling machine sterilization.

BACKGROUND

Known filling machines include those with a rotor, filling points on the rotor's periphery, and a supply of liquid filling-material that supplies filling elements at the filling point.

It is useful that such machines be scrupulously clean. In particular, it is useful to take measures to prevent contaminants from entering the supply of liquid filling-material. It is also useful to prevent contamination that originates inside the filling machine. To some extent, this can be done by an internal cleaning procedure called "CIP cleaning."

SUMMARY

In an apparatus according to the invention, there is no need for a rotary connection for supplying liquid filling-material to the rotor, as is usually the case in conventional rotating filling machines. This substantially simplifies the construction, not only by the omission of the normal rotary passage but also by the reduction of the piping complexity and the necessary rotating seals.

In the filling machine according to the invention, only the filling-material boiler is configured to co-rotate with the rotor. The cover does not rotate with the rotor. Instead, it is firmly held on the machine frame.

The transition between the cover and the filling-material boiler is sealed by at least one seal. This seal suppresses the ingress of substances, media, and in particular bacteria from the outside into the interior of the filling-material boiler. The filling machine is suitable for use as an aseptic machine, i.e. for aseptic filling of material into the container.

By sealing the transition between the filling-material boiler and the cover, it is furthermore possible to pressurize a gas chamber that is formed above the filling material level in the partially filled boiler during the filling operation. Preferably, this chamber is pressurized with an inert gas under pressure. Suitable gases include sterile air, nitrogen, or CO2 gas under pressure. Such pressurization promotes the exclusion of germs or foreign bodies.

The filling machine according to the invention can be used for widely varying filling processes. For example the filling machine can be used for pressureless filling of containers. In such cases, the gas chamber formed in the filling-material boiler is preferably only pressurized with a slight positive pressure. Examples of suitable positive pressures are those between about 40 mbar up to about 60 mbar. A useful positive pressure is one around 50 mbar.

The filling machine can also be used for pressure-filling of the containers by pressurizing the gas chamber in the filling-material boiler up to a correspondingly higher pressure.

The configuration of an apparatus according to the invention simplifies cleaning and/or disinfecting of the filling machine, and in particular of the filling-material boiler and ensures that it such cleaning is carried out with high quality and certainty. In particular for aseptic machines, an apparatus configured according to the invention is safer since risky areas are minimized.

During cleaning and/or disinfecting, e.g. CIP cleaning and/or disinfecting, the corresponding medium (including, for example, hot water vapor) is supplied preferably via a connection provided on a boiler cover. This connection opens tangentially into the filling-material boiler interior relative to the vertical machine axis. The result is a circulating flow of the cleaning and/or disinfecting medium about the machine axis within the boiler. This leads to intensive cleaning and/or disinfecting. During cleaning and/or disinfecting, it is useful to perform a rotary and/or swivel movement relative to the connection or the cover or cover part facing the connection and the filling-material boiler about the machine axis.

In one embodiment, the filling elements are connected to the filling-material boiler via product lines. In a further embodiment, the filling-material boiler forms a buffer tank that is connected to a further product boiler to which the filling elements are connected. An example of such a boiler is a ring boiler.

In one aspect, the invention features an apparatus for filling containers with liquid filling-material. Such an apparatus includes a filling machine having a rotor mounted on a machine frame by a rotor bearing for rotation about a machine axis, filling elements disposed on the rotor, container carriers, a container infeed that receives containers to be filled, a container outfeed that provides filled containers for removal, a first filling-material boiler, a boiler-cover that covers the boiler, a product connection that supplies liquid filling-material into the boiler, and a seal to seal a transition between the boiler-cover and the first filling-material boiler. A filling element and a container carrier together form a filling point.

During filling, each container carrier carries a container such that its axis is parallel to the machine axis. Containers are filled within a range of angles on the rotor between the container infeed and the container outfeed. The first filling-material boiler is arranged on the rotor and rotates with the rotor. The boiler-cover, which is connected to the machine-frame, does not rotate with the rotor.

Some embodiments include a bearing arrangement that is disposed either between the first filling-material boiler and the boiler-cover or between the first filling-material boiler and a part of the machine frame that carries the boiler-cover. Among these are embodiments in which the bearing arrangement includes a ball-bearing slewing-ring.

In other embodiments, the first filling-material boiler includes a fluid chamber, and the product connection opens into the fluid chamber.

Also among the embodiments are those in which the seal includes first and second ring-faces, the first being on the boiler, and the second being on the cover and opposite the first ring-face, and a first ring-seal that lays against the first and second ring-faces, and inner and outer faces, the inner face including an inner face of the boiler and that forms the first ring-face, and the outer face being an outer face of the cover. In these embodiments, the boiler-cover includes a boiler-cover portion that extends into the first filling-material boiler. Among these embodiments are those that include a second ring seal that is offset from the first in a direction along the machine axis. These two ring seals cooperate to seal the transition. The ring chamber is thus disposed between them. A gas connection in fluid communication with the ring chamber passes gas into the ring chamber, thus pressurizing it. This makes the ring chamber a protective chamber.

Some embodiments include first and second product-lines that connect corresponding first and second filling-elements to the boiler.

Other embodiments include a second filling-material boiler on the rotor, together with first and second product-lines that connect corresponding filling elements to the second filling-material boiler. In these embodiments, the first filling-material boiler defines a buffer tank that connects to the second filling-material boiler.

Other embodiments include a ring boiler disposed on the rotor, together with first and second product-lines that connect corresponding filling elements to the ring boiler. In these embodiments, the first filling-material boiler defines a buffer tank that connects to the ring boiler.

Some embodiments also feature a tangential connection into the first filling-material boiler. This tangential connection is oriented to direct flow into the first filling-material boiler at a non-zero angle relative to the machine axis.

Also among the embodiments are those in which the rotor bearing completely supports the filling machine, thus eliminating a need for an additional ball-bearing slewing-ring. In such embodiments, the boiler-cover is fixed above the rotor bearing and the cover is mounted such that its center intersects the machine axis.

In another aspect, the invention features a method of using a filling machine as set forth above. Such a method includes supplying the liquid filling-material to the filling-material boiler, causing creation of a gas chamber in the filling-material boiler, causing creation of a liquid chamber in the filling-material boiler, the liquid chamber being below the gas chamber, and pressurizing the gas chamber with inert gas to create a positive pressure of between 40 millibars and 50 millibars in the filling-material boiler.

Some practices further include keeping the seal free of contact with the liquid-filling material.

Yet other practices include supplying a medium into the filling-material boiler under pressure through a tangential connection that creates a circular flow of the medium. In these practices, the pressure is up to 3 bar above atmospheric pressure. The medium is either a cleaning medium or a sterilizing medium.

In another aspect, the invention features a filling machine includes a rotor, a rotor bearing that mounts the rotor on the machine-frame for rotation about a machine axis, and filling elements disposed on the rotor. Each filling element, together with a container carrier, defines a filling point. The machine includes a filling-material boiler arranged on the rotor and configured to rotate with the rotor, as well as a boiler-cover connected to the machine-frame and configured to not rotate with the rotor, and a seal. The seal seals a transition between the boiler cover and the filling-material boiler. As used herein, terms such as "substantially" or "approximately" mean deviations from the precise value by ±10%, preferably by ±5%, and/or deviations in the form of changes insignificant to function.

Refinements, advantages and possible applications of the invention arise from the description below of exemplary embodiments and from the figures. All features described and/or shown in the figures are in principle the subject of the invention, either alone or in any combination, irrespective of their summary in the claims or back reference. The content of the claims is also made a constituent part of the description.

BRIEF DESCRIPTION OF THE DRAWINGS

These and other features of the invention will be apparent from the following detailed description and the accompanying figures, in which.

DETAILED DESCRIPTION

Figure 1:
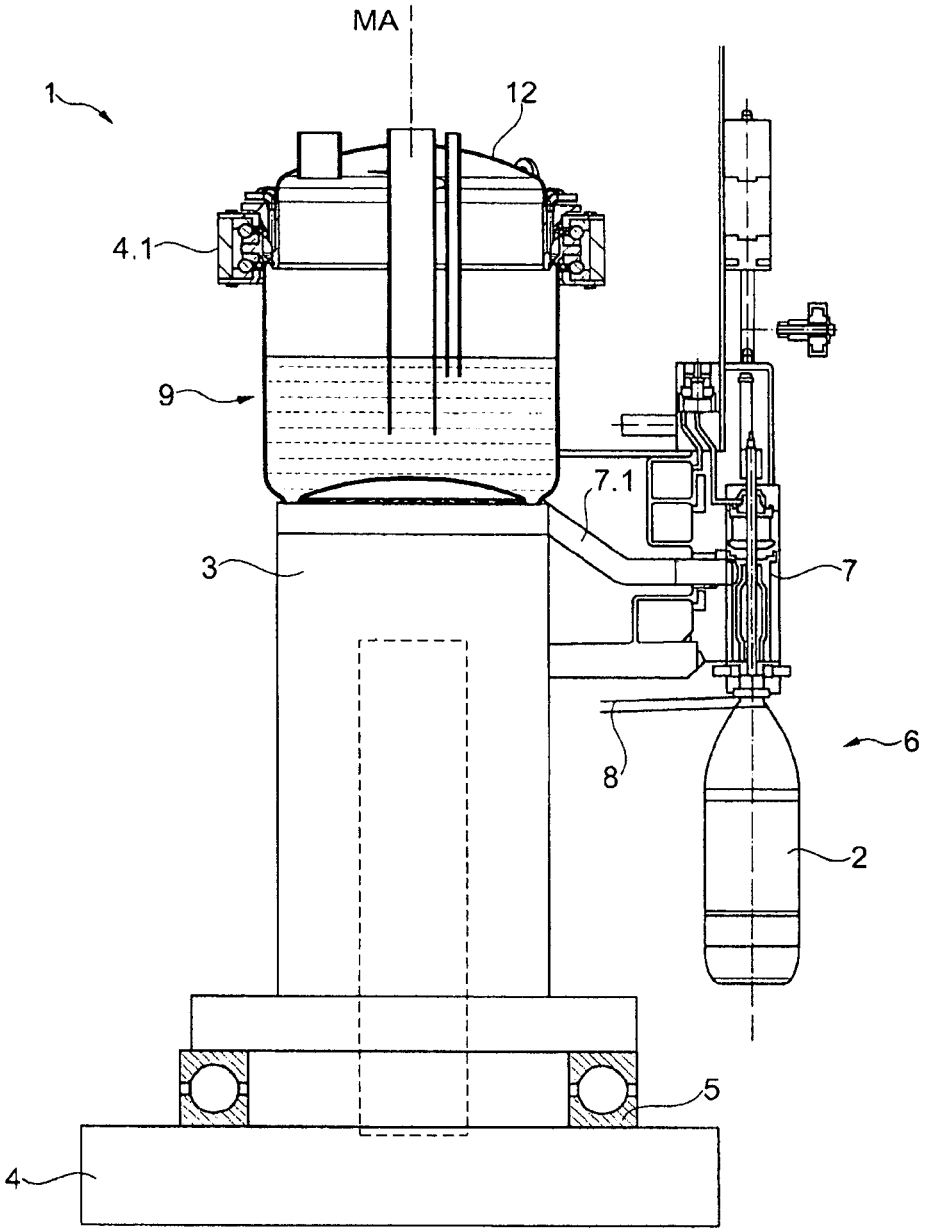
FIG. 1 is a simplified diagram of a rotating filling machine for filling bottles with a liquid filling-material.

FIG. 1 shows a filling machine 1 that fills containers, such as bottles 2, with a liquid filling-material. Typically, the liquid filling-material is a beverage.

The filling machine 1 has a rotor 3 that is mounted on a machine frame 4 via a rotor bearing 5. An example of a rotor bearing 5 is a ball-bearing slewing-guide. During filling, the rotor 3 rotates about a vertical machine axis MA.

Filling points 6 are distributed around the periphery of the rotor 3 at equal angular distances from each other and at the same radial distance from the machine axis MA. Each filling point 6 has a filling element 7 and a container carrier 8. During the filling operation, the container carrier 8 suspends a bottle 2 in such a way as to place its bottle mouth at a discharge opening of the filling element 7 and to orient its bottle axis parallel to the machine axis MA.

A filling-material boiler 9 common to all filling elements 7 of the filling machine 1 is provided on the rotor 3. The filling-material boiler 9 connects to the filling elements 7 via product lines 7.1. During the filling operation, liquid filling-material partly fills the filling-material boiler 9, thus forming a liquid chamber 9.1 containing the filling material, and above the liquid chamber 9.1, a gas chamber 9.2. An inert gas fills the gas chamber 9.2 with a positive pressure to suppress ingress of foreign bodies and/or bacteria into the filling-material boiler 9. Suitable inert gases include $CO_2$ gas, sterile air, and nitrogen. A suitable positive pressure would be in a range between approximately 40 mbar and approximately 60 mbar.

In the embodiment shown, the filling-material boiler 9 is a cup-like structure that is rotationally symmetrical about and coaxial with the machine axis MA. The filling-material boiler 9 has a boiler base 10 and a circular cylindrical or substantially circular cylindrical boiler wall 11. A boiler cover 12 closes the top of the boiler 9. Unlike the filling-material boiler 9, the boiler cover 12 does not rotate about the machine axis MA with the rotor 3. Instead, it is connected to the machine frame 4, and in particular to a part of the machine frame 4, for example via a torque pick-up. In the embodiment shown, the boiler cover 12 is connected to a ring 4.1 of the machine frame 4.

Figure 2:
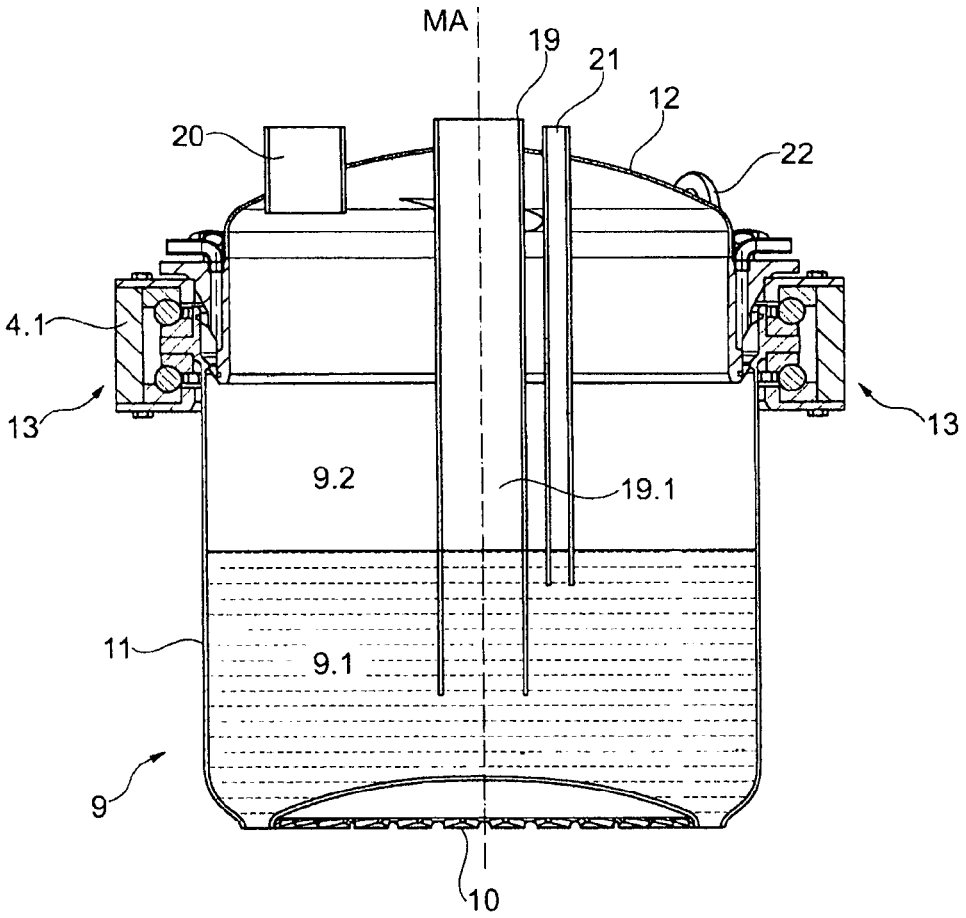
FIG. 2 is an enlarged cross-sectional view of the boiler shown in FIG. 1.
Figure 3:
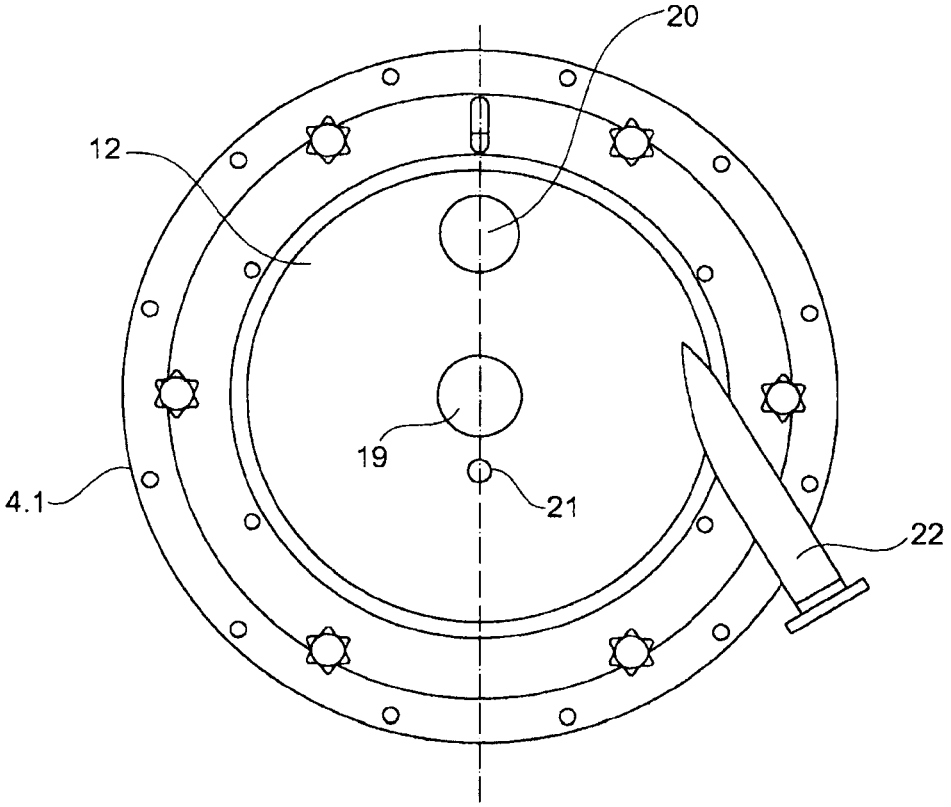
FIG. 3 is a top view of the boiler shown in FIG. 2.

FIG. 2 shows a bearing arrangement 13 to which the filling-material boiler 9 is rotatably connected in the region of its top via the boiler cover 12 and the ring 4.1 of the machine frame 4. The actual mounting of the rotor 3, and hence of the filling-material boiler 9, takes place via the rotor bearing 5.

Figure 4:
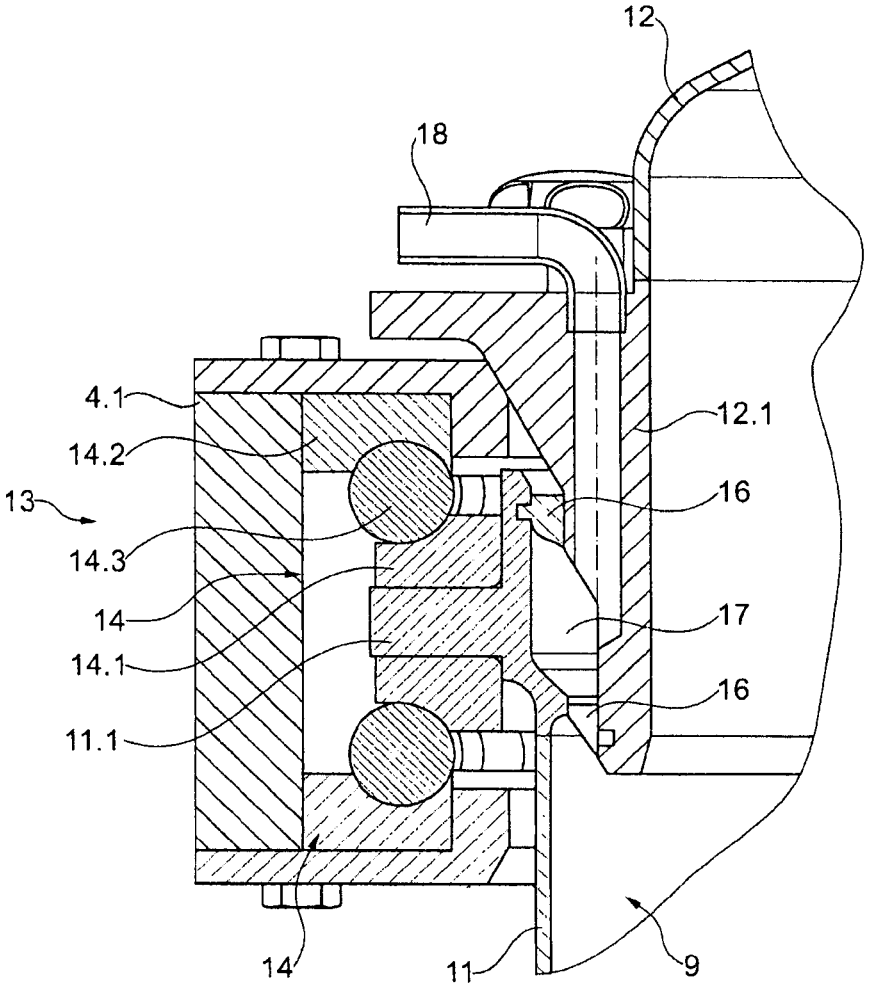
FIG. 4 is a detailed view of a mounting between the boiler shown in FIG. 2 and its cover.

FIG. 4 shows the bearing arrangement 13 in more detail. The bearing arrangement 13 includes an upper and lower ball-bearing slewing-rings 14, each of which has first and second raceways 14.1, 14.2. The first raceway 14.1 is a boiler-side raceway that lies on an annular flange 11.1 protruding radially beyond an outer face of the boiler wall 11. The second raceway 14.2 is on the ring 4.1. A plurality of balls is arranged between these two raceways 14.1, 14.2.

It is of particular importance that the transition between the filling-material boiler 9, which co-rotates with the rotor 3, and the boiler cover 12, which is fixedly connected to the machine frame 4, be tightly sealed. This ensures that the interior of the filling-material boiler 9 is hermetically sealed from the outside. Such a seal suppresses ingress of bacteria into the filling material and also facilitates maintenance of a positive pressure in the filling-material boiler 9. In addition, such a seal makes it possible to carry out pressurized cleaning and/or disinfecting, in particular pressurized CIP cleaning and/or disinfecting. In the embodiment shown, such pressurized cleaning up to a positive pressure of as much as 3.5 bar is possible.

Referring again to FIG. 4, in the region of its cover edge, the boiler cover 12 has a boiler-cover portion 12.1 protruding into the filling-material boiler 9. In the illustrated embodiment, the boiler-cover portion 12.1 is a cylindrical structure having a circular cross-section. Two ring seals 16 are provided between this boiler-cover portion 12.1 and the inner face of the filling-material boiler 9.

The ring seals 16 concentrically surround the machine axis MA and are radially offset from each other relative to the machine axis MA. Each ring seal 16 lays against an inner face of the filling-material boiler 9 and an outer face of the boiler-cover portion 12.1. The ring seals 16 thus seal the transition, or gap, between the filling-material boiler 9 and the boiler-cover portion 12.1.

In addition, the ring seals 16 define an annular chamber 17 that surrounds the machine axis MA. The annular chamber 17 is bounded by the two ring seals 16, the inner face of the filling-material boiler 9, and the outer face of the boiler-cover portion 12.1.

During a filling operation, a connection 18 formed in the boiler cover 12 delivers gas under slight positive pressure to the annular chamber 17. A suitable protective gas is an inert gas, sterile air, nitrogen, or carbon dioxide. When thus pressurized, the annular chamber 17 becomes a protective chamber that resists penetration of foreign bodies from the environment into the interior of the filling-material boiler 9. Of particular interest is resisting penetration by bacteria or other microorganisms.

Referring back to FIG. 2, various connections pass through the boiler cover 12 through apertures provided with seals. Among these connections is a first connection 19 formed by a tubular piece 19.1 that is open at both ends and that is arranged to be coaxial with the machine axis MA. A lower end of the tubular piece 19.1 extends into the fluid chamber 9.1 so that the filling-material boiler 9 is filled with the product from below the surface. This product connection 19, which also does not rotate with the rotor 3 and the filling-material boiler 9, connects to an external line for the supply of filling material.

Also provided on the boiler cover 12 is a second connection 20 for the supply and discharge of further media, for example for the supply of inert gas into the gas chamber 9.2. A third connection 21 functions as a riser pipe. A fourth connection 22 is a tangential connection that is oriented tangentially or substantially tangentially into the boiler interior relative to the machine axis MA. This fourth connection 22 supplies CIP media during CIP cleaning and/or sterilization of the boiler 9 and the filling machine 1. Examples of CIP media include liquid, gaseous, and/or vaporous cleaning media.

During cleaning and/or sterilization (e.g. CIP cleaning and/or sterilization), the cleaning medium is introduced via the fourth connection 22. Because of the orientation of the fourth connection 22, it is possible to optimally treat the entire inner face of the filling-material boiler 9 with CIP medium.

The tangential path followed by the cleaning and/or disinfecting media makes it possible to omit at least some of the spray heads that would otherwise be arranged inside the filling-material boiler 9. This is because the tangential inflow of the cleaning and/or disinfecting medium creates a circular flow in the filling-material boiler 9 that intensifies the cleaning and/or sterilization of the filling-material boiler. This particular method of cleaning and/or sterilization of the rotor-side filling-material boiler 9 is a direct result of the configuration of the filling machine 1 described herein, and in particular, because the cleaning and/or sterilization medium is introduced directly into the filling-material boiler 9 in a tangential direction via the fourth connection 22.

Figure 5:
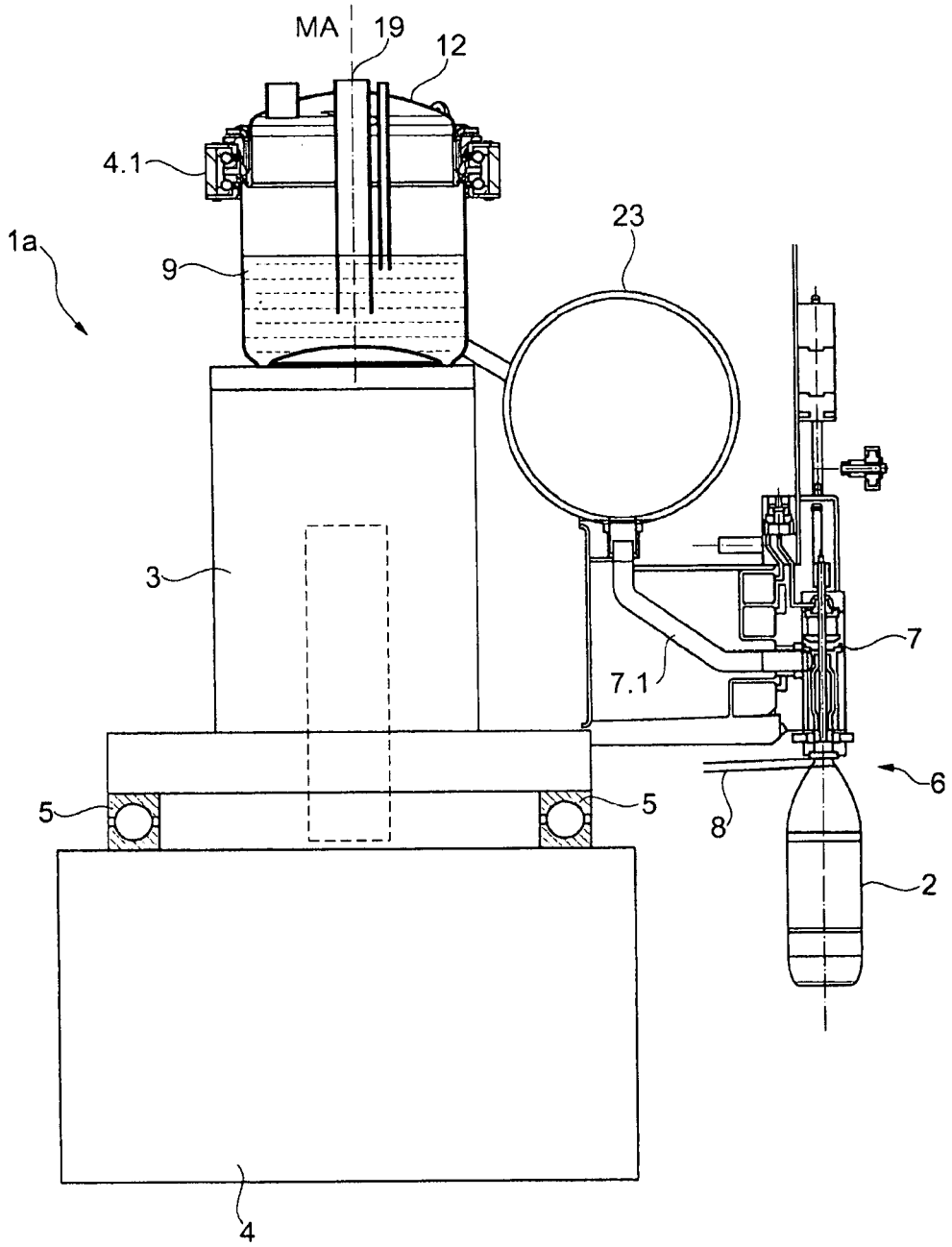
FIG. 5 shows an alternative embodiment of the filling machine shown in FIG. 1.

It has been assumed above that the filling-material boiler 9 is the only filling-material boiler common to all filling elements 7 of the filling machine 1. However, in the embodiment shown in FIG. 5, a filling machine 1*a* similar to that shown in FIG. 1 also has a ring boiler 23 that is connected to the filling elements 7 via the product lines 7.1. In this embodiment, the filling-material boiler 9 serves as a rotor-side buffer tank for the filling material and connects to the ring boiler 23. The ring boiler 23 is common to all the filling elements 7 and connects to the filling elements 7 via one or more product lines 7.1.

In another embodiment, only one ring seal creates the seal between the filling-material boiler 9 and boiler cover 12. In other embodiments, more than two ring seals cooperate to create the seal.

Additional embodiments include those in which the bearing between the filling-material boiler 9 and boiler cover 12, or the part of the machine frame 4 carrying this boiler cover 12, is implemented differently from the manner described. For example, in some such embodiments, there is just one ball-bearing slewing-guide 14.

It is also possible to configure the filling machine and/or the filling method such that the product to be filled has no contact with the seal provided for sealing a gap between a mobile part of the filling machine 1, la and an immobile part of the filling machine 1, la. This embodiment is advantageous because it reliably suppresses the possibility of abraded material from the seals entering the filling material.

In yet other embodiments, the boiler cover 12 is mounted rotationally centrally, fixedly above the rotating rotor. In these embodiments, a bearing of the filling machine 1*a* includes only the rotor bearing. No additional ball-bearing slewing-ring is necessary. This embodiment is advantageous because it educes the mechanical and structural complexity, and hence the cost of a filling machine according to the invention.

Having described the invention, and a preferred embodiment thereof, what is claimed as new and secured by Letters Patent is:

1. An apparatus for filling containers with liquid filling-material, said apparatus comprising a filling machine, said filling machine comprising a rotor, a rotor bearing, a machine-frame, filling elements, container carriers, filling points, a container infeed, a container outfeed, a first filling-material boiler, a boiler-cover, a product connection, and a seal, wherein said rotor bearing mounts said rotor on said machine-frame for rotation about a machine axis, wherein said filling elements are disposed on said rotor, wherein one of said filling elements and one of said container carriers forms one of said filling points, wherein containers to be filled are provided at said container infeed, wherein filled containers are removed from said outfeed, wherein, during filling, said container carriers carry said containers at an angle such that a container axis is parallel to said machine axis, wherein said containers are filled within a range of angles on said rotor between said container infeed and said container outfeed, wherein said first filling-material boiler is arranged on said rotor, wherein said first filling-material boiler rotates with said rotor, wherein said boiler-cover closes said first filling-material boiler, wherein said boiler-cover connects to said machine-frame, wherein said boiler-cover does not rotate with said rotor, wherein said product connection supplies liquid filling-material into said first filling-material boiler, and wherein a seal is disposed to seal a transition between said boiler-cover and said first filling-material boiler, wherein said first filling-material boiler is partially filled with said liquid filling-material up to a filling-material level, wherein a gas chamber is formed in said first filling-material boiler above said filling-material level, wherein, as a result of said seal being disposed to seal said transition, said gas chamber can be subjected to an inert gas under a positive pressure during filling of a container with said liquid filling-material.

2. The apparatus of claim 1, further comprising a bearing arrangement, wherein said bearing arrangement is disposed between said first filling-material boiler and said boiler-cover.

3. The apparatus of claim 1, further comprising a bearing arrangement, wherein said bearing arrangement is disposed between said first filling-material boiler and a part of said machine-frame and wherein said part of said machine-frame carries said cover.

4. The apparatus of claim 2, wherein said bearing arrangement comprises a ball-bearing slewing-ring.

5. The apparatus of claim 3, wherein said bearing arrangement comprises a ball-bearing slewing-ring.

6. The apparatus of claim 1, wherein said first filling-material boiler comprises a fluid chamber and wherein said product connection opens into said fluid chamber.

7. The apparatus of claim 1, wherein said seal comprises a first ring-seal, a first ring-face, a second ring-face, an inner face, and an outer face, wherein said first ring-face is a ring face on said first filling-material boiler, wherein said second ring-face is a ring face on said boiler-cover, wherein said first ring-seal lays against said first ring-face and said second ring-face, wherein said first ring-face is disposed opposite said second ring-face, wherein said inner face comprises an inner face of said first filling-material boiler, wherein said inner face forms said first ring-face, wherein said boiler-cover comprises a boiler-cover portion that extends into said first filling-material boiler, and wherein said outer face is an outer face of said boiler-cover portion.

8. The apparatus of claim 7, further comprising a protective chamber, second ring-seal, a gas connection, and a ring chamber, wherein said first and second ring-seals are offset from each other in a direction along said machine axis, wherein said first and second ring-seals cooperate to seal said transition, wherein said ring chamber is disposed between said first and second ring-seals, wherein said gas connection is in fluid communication with said ring chamber to enable pressurization of said ring chamber with gas provided through said gas connection, thereby causing said ring chamber to become said protective chamber.

9. The apparatus of claim 1, further comprising first and second product-lines, wherein said filling elements comprise first and second filling-elements, wherein said first product-line connects said first filling-material boiler to said first filling-element, and wherein said second product-line connects said first filling-material boiler to said second filling-element.

10. The apparatus of claim 1, further comprising a second filling-material boiler, a first product-line, a second product-line, and a buffer tank, wherein said first filling-material boiler defines said buffer tank, wherein said buffer tank connects to said second filling-material boiler, wherein said second filling-material boiler is on said rotor, wherein said filling elements comprise a first filling-element and a second filling-element, wherein said first product line connects said first filling-element to said second filling-material boiler, and wherein said second product line connects said second filling-material boiler to said second filling-element.

11. The apparatus of claim 1, further comprising first and second product-lines, a buffer tank, and a ring boiler disposed on said rotor and connected to said first filling-material boiler, wherein said first filling-material boiler defines said buffer tank, wherein said filling elements comprise first and second filling-elements connected to said ring boiler by said first and second product-lines respectively.

12. The apparatus of claim 1, further comprising a tangential connection into said first filling-material boiler, wherein said tangential connection is oriented to direct flow into said first filling-material boiler at a non-zero angle relative to said machine axis.

13. The apparatus of claim 1, wherein said rotor bearing completely supports said filling machine, thus eliminating a need for an additional ball-bearing slewing-ring, wherein said boiler-cover is mounted to be fixed above said rotor bearing, wherein said cover is mounted such that a center of said cover intersects said machine axis.

14. A method of using a filling machine that includes a rotor, a rotor bearing that mounts said rotor on a machine-frame for rotation about a machine axis, filling elements disposed on said rotor, each filling element, together with a container carrier that carries containers parallel to the machine axis, defining a filling point, a container infeed that receives containers to be filled in said filling machine, a container outfeed that provides filled containers that have been filled by said filling machine, a filling-material boiler arranged on said rotor and configured to rotate with said rotor, a boiler-cover connected to said machine-frame and configured to not rotate with said rotor, a product connection, and a seal, that seals a transition between said boiler cover and said filling-material boiler, said method comprising:

supplying said liquid filling-material to said filling-material boiler, causing creation of a gas chamber in said filling-material boiler, causing creation of a liquid chamber in said filling-material boiler, said liquid chamber being below said gas chamber, filling a container with the liquid filling-material, and during the filling, pressurizing said gas chamber with inert gas to create a positive pressure of between 40 millibars and 50 millibars in said filling-material boiler.

15. The method of claim 14, further comprising keeping said seal free of contact with said liquid-filling material.

16. The method of claim 14, further comprising supplying a medium into said filling-material boiler under pressure through a tangential connection that creates a circular flow of said medium, wherein said pressure is up to 3 bar above atmospheric pressure, and wherein said medium is selected from the group consisting of a cleaning medium and a sterilizing medium.

* * * * *